US011458602B1

(12) United States Patent
Marin

(10) Patent No.: US 11,458,602 B1
(45) Date of Patent: Oct. 4, 2022

(54) HEX TOOL

(71) Applicant: Raul Marin, Denver, CO (US)

(72) Inventor: Raul Marin, Denver, CO (US)

( * ) Notice: Subject to any disclaimer, the term of this patent is extended or adjusted under 35 U.S.C. 154(b) by 0 days.

(21) Appl. No.: 17/832,963

(22) Filed: Jun. 6, 2022

Related U.S. Application Data

(60) Provisional application No. 63/274,279, filed on Nov. 1, 2021.

(51) Int. Cl.
*B25B 15/00* (2006.01)
*B25B 13/48* (2006.01)
*B25B 13/06* (2006.01)

(52) U.S. Cl.
CPC ..... *B25B 15/008* (2013.01); *B25B 13/06* (2013.01); *B25B 13/481* (2013.01)

(58) Field of Classification Search
CPC ..... B25B 15/008; B25B 13/481; B25B 13/06
See application file for complete search history.

(56) References Cited

U.S. PATENT DOCUMENTS 3,897,703 A * 8/1975 Phipps ..... B25B 13/06 81/177.75
5,056,951 A * 10/1991 Mariani ..... F16M 11/08 403/114
6,279,430 B1 * 8/2001 Hsieh ..... B25G 1/063 81/177.1
6,729,211 B1 * 5/2004 Snow ..... B25B 13/481 81/177.75
8,650,992 B2 * 2/2014 Neitzell ..... B25B 13/481 81/177.85
8,956,236 B2 * 2/2015 Chu ..... F16C 11/0604 81/177.75
2009/0255379 A1 * 10/2009 Hsieh ..... B25B 13/481 81/124.5
2010/0294092 A1 * 11/2010 Hu ..... B25B 23/0028 81/177.75
2015/0005080 A1 * 1/2015 Chu ..... B25B 23/0014 464/157
2015/0033916 A1 * 2/2015 Yang ..... B25B 13/481 81/177.8
2015/0094157 A1 * 4/2015 Lock ..... B25B 13/06 464/147
2015/0298303 A1 * 10/2015 Hon ..... B25B 15/008 81/450
2016/0193723 A1 * 7/2016 Su ..... B25B 23/0035 81/177.85

* cited by examiner

*Primary Examiner* — David B. Thomas
(74) *Attorney, Agent, or Firm* — Hall Estill Law Firm

(57) ABSTRACT

A hex tool including a hex head having a hex portion for engaging socket head cap screws or wrenches. The hex portion also having a body portion extending from the hex portion. The body portion having a spherical-shaped cavity disposed therein. The hex tool also includes a handle with a ball end and a primary handle portion. The ball end disposed in the spherical-shaped cavity to provide the hex tool a significant range of motion during use. Another type of hex tool having a hex head having a hex cavity for engaging a hex head bolt. The hex head also having a body portion extending from the hex cavity. The body portion having a spherical-shaped cavity disposed therein. The hex tool also including a handle with a ball end and a primary handle portion. The ball end disposed in the spherical-shaped cavity to provide the hex tool a significant range of motion during use.

16 Claims, 5 Drawing Sheets

HEX TOOL

CROSS-REFERENCE TO RELATED APPLICATIONS

The present application is a conversion of U.S. Provisional Application having U.S. Ser. No. 63/274,279, filed Nov. 1, 2021, which claims the benefit under 35 U.S.C. 119(e). The disclosure of which is hereby expressly incorporated herein by reference.

STATEMENT REGARDING FEDERALLY SPONSORED RESEARCH OR DEVELOPMENT

Not applicable.

BACKGROUND OF THE DISCLOSURE

1. Field of the Invention

The present disclosure relates to a hex tool with a spherical joint to provide the hex tool with more accessibility to certain spaces, more approach angles, more operation angles and can work in conjunction with other tools.

2. Description of the Related Art

Typical hex tools, such as Allen wrenches, are rigid tools where an engagement end is perpendicular to the handle. Thus, the accessibility of the typical hex tool is limited due to the rigid design.

Accordingly, there is a need for a hex tool with a design that provides more accessibility to certain spaces and increased operability.

SUMMARY OF THE DISCLOSURE

The present disclosure is directed to a hex tool. The hex tool including a hex head having a hex portion for engaging socket head cap screws or wrenches. The hex portion also having a body portion extending from the hex portion. The body portion having a spherical-shaped cavity disposed therein. The hex tool also includes a handle with a ball end and a primary handle portion. The ball end disposed in the spherical-shaped cavity to provide the hex tool a significant range of motion during use.

The present disclosure is also directed to another type of hex tool. The hex tool having a hex head having a hex cavity for engaging a hex head bolt. The hex head also having a body portion extending from the hex cavity. The body portion having a spherical-shaped cavity disposed therein. The hex tool also including a handle with a ball end and a primary handle portion. The ball end disposed in the spherical-shaped cavity to provide the hex tool a significant range of motion during use.

DETAILED DESCRIPTION OF THE DISCLOSURE

Figure 1:
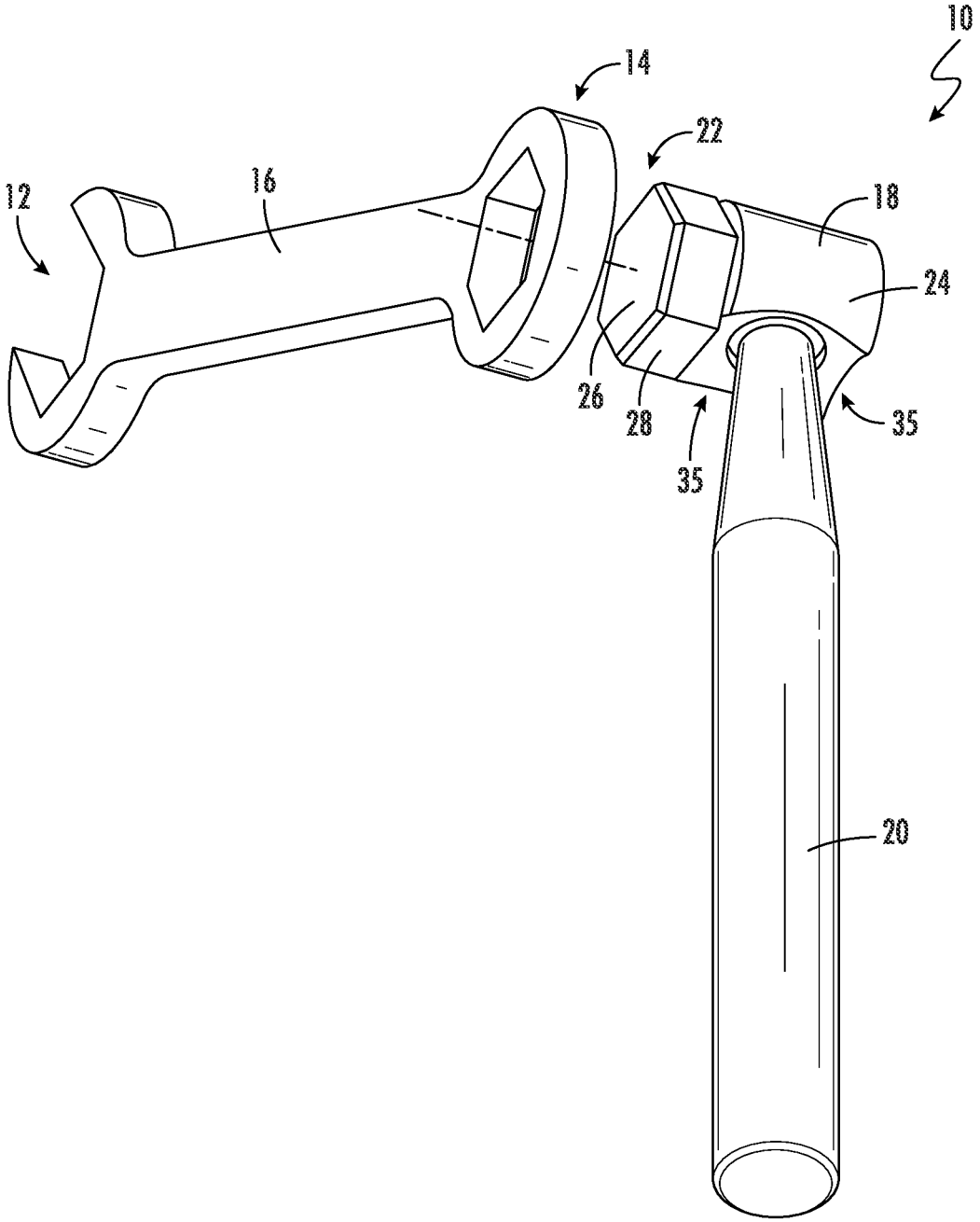
FIG. 1 is a perspective view of a hex tool constructed in accordance with the present disclosure and a wrench.
Figure 2:
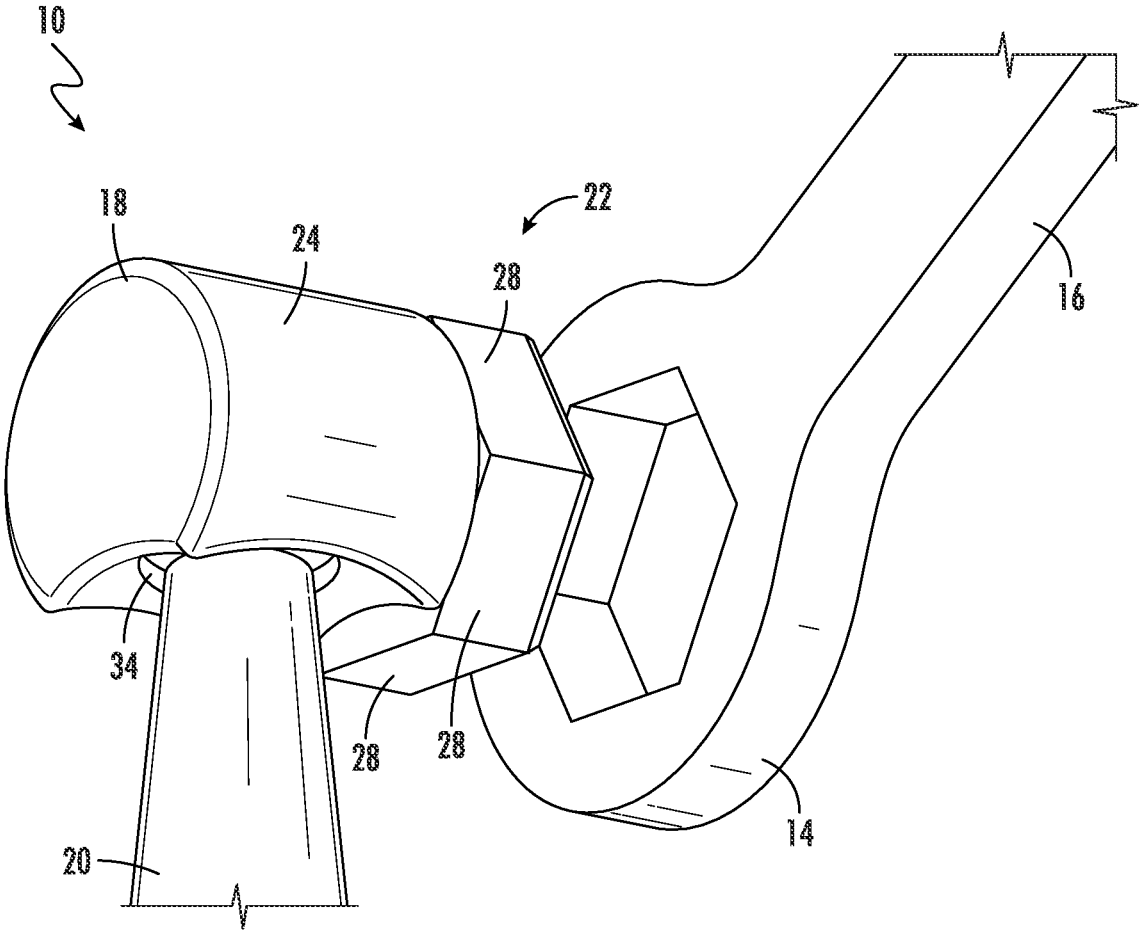
FIG. 2 is a perspective view of a portion of the hex tool constructed in accordance with the present disclosure and a portion of the wrench.
Figure 3:
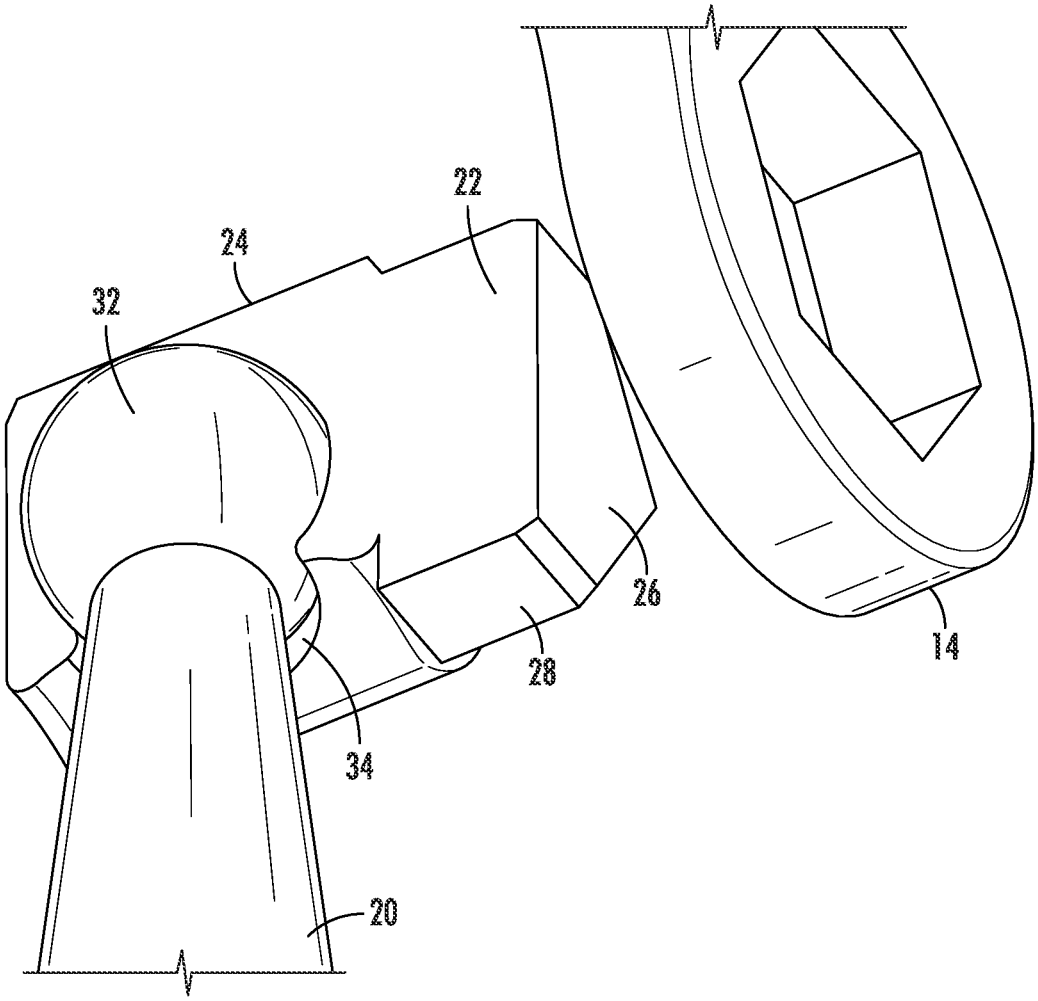
FIG. 3 is a perspective view of a cross-sectional view of the portion of the hex tool shown in FIG. 2.
Figure 4:
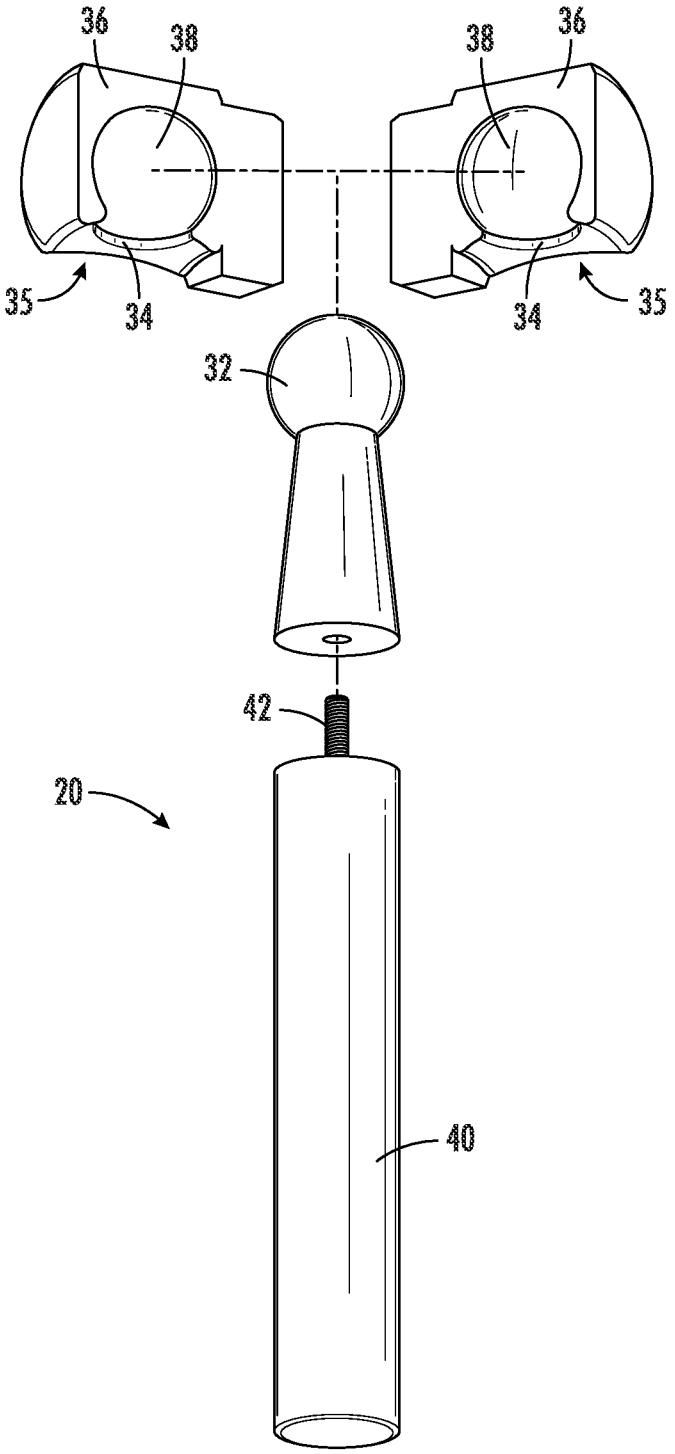
FIG. 4 is an exploded, perspective view of one embodiment of the hex tool constructed in accordance with the present disclosure.
Figure 5:
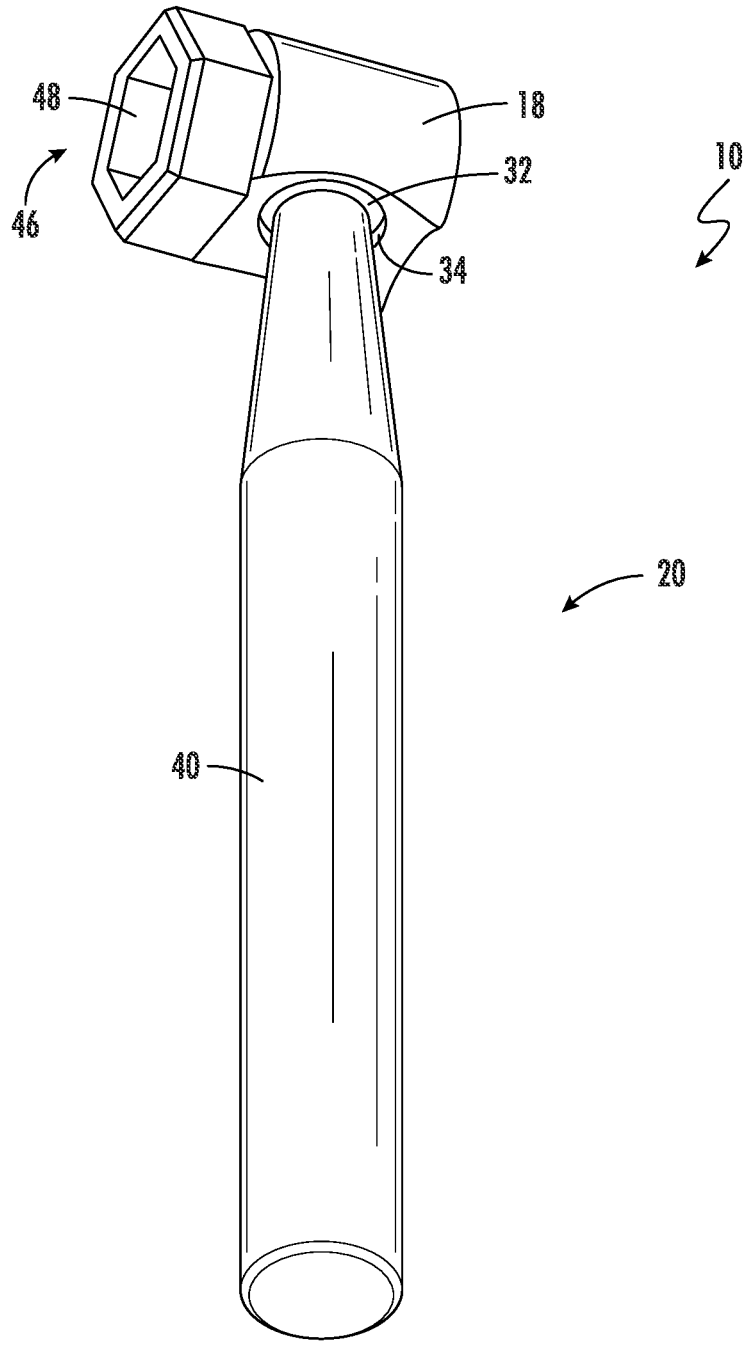
FIG. 5 is a perspective view of another embodiment of a hex tool constructed in accordance with the present disclosure.

The present disclosure relates to a hex tool 10 for engaging a socket head cap screw or a wrench that can be engaged with a hex head bolt. For example, the hex tool 10 can engage with an open end 12 or a box end 14 of a combination wrench 16, a box end wrench or an open ended wrench. The hex tool 10 can engage with a wrench 16 to provide additional torque on a screw or bolt or to provide additional length to the wrench 16. The hex tool 10 can also permit the wrench 16 functional access to a screw or bolt due to the functional aspects of the hex tool 10.

The hex tool 10 can include a hex head 18 for engaging directly with the socket head cap screw or the wrench 16 and a handle 20 extending from the hex head 18 for providing a user of the hex tool 10 a place to grip and control the hex tool 10. The hex head 18 can be spherically jointed with the handle 20. The hex head 18 can have a hex portion 22 that directly engages with the socket head cap screw on one end of a wrench and a body 24 attached to the hex portion 22. The hex portion 22 includes a base 26 with six sides 28 extending therefrom. The six sides 28 have equal lengths. The body 24 can be securely attached to the hex portion 22 of the hex head 18. In one embodiment, the hex portion 22 and the body 24 can be formed from one homogenous piece of material. The hex portion 22 of the hex head 18 can be made in various sizes so as to be able to fit multiple different sized socket head cap screws or wrenches. The hex portion 22 of the hex head 18 can come in imperial or metric sizes.

The body 24 of the hex head 18 has a spherical-shaped cavity 30 disposed therein for receiving a ball end 32 of the handle. It should be understood and appreciated that the spherical-shaped cavity 30 is not a full sphere. The size of the spherical-shaped cavity 30 is limited by an opening 34 in the side of the body 24 that permits the handle 20 to extend therethrough and away from the body 24 of the hex head 18. The ball end 32 of the handle 20 in the spherical-shaped cavity 30 allows the handle 20 of the hex tool 10 to rotate and swivel therein. The ball end 32 of the handle 20 will be able to completely rotate in some directions, and only partially rotate in other directions. The size of the opening 34 in the body 24 partially determines the extent of the movement of the handle 20 relative to the body 24. The size of the handle 20 at the opening 34 in the body 24 also contributes to the extent of the movement of the handle 20 relative to the body 24 of the hex head 18. The diameter of the opening 34 can vary but the diameter has to be larger than the part of the handle 20 that passes through the opening 34 and smaller than the diameter of the ball end 32 of the handle 20. The body 24 of the hex head 18 can have removed portions 35 adjacent to the opening 34 to permit the handle 20 even more range of motion. Another way to say this is that the opening 34 is inset in the body portion 24 of the hex head 18.

The hex head 18 and handle 20 can be put together in any manner known in the art. For example, the hex head 18 could come in two parts 36 wherein each part 36 has a cavity 38 disposed therein. The cavity 38 in each part 36 of the hex head 18 cooperated, once the two parts 36 of the hex head 18 are secured together, to create the spherical-shaped cavity 30. The two parts 36 of the hex head 18 could be vertically disposed parts 36 or horizontally disposed parts 36. The two parts 36 of the hex head 18 could be secured together in any manner known in the art, such as welded, screwed, etc.

In a further embodiment of the present disclosure, the ball end 32 of the handle 20 (and possibly some small extended part) can be separate from a primary handle portion 40 wherein the primary handle portion 40 of the handle 20 and the ball end 32 of the handle 20 can be selectively secured together. For example, the primary handle portion 40 can have a screw element 42 extending therefrom that can engage a threaded opening 44 in the ball end 32 of the handle 20 (or the small extended part of the ball end). With the hex tool 10, or more specifically the handle 20, designed this way, it would permit a hex tool kit to be generated. A hex tool kit could include one primary handle portion 40 and multiple different sized hex heads 18 wherein each hex head 18 has a separate ball end 32 of the handle 20 disposed therein. This would allow a user to take the primary handle portion 40 and secure it to a desirously sized hex head 18. In yet another embodiment, the ball end 32 of the handle 20 and the primary handle 40 can be selectively secured together with a quick disconnect style connection. The quick disconnect style connection can be any type known by one of ordinary skill in the art.

In a further embodiment of the present disclosure, the hex head tool 10 could have a hex cavity 46 extending from the body 24 to engage a hex head bolt. The hex cavity 46 would have internal sidewalls 48 that create six equally-sized internal sidewalls 48.

From the above description, it is clear that the present disclosure is well-adapted to carry out the objectives and to attain the advantages mentioned herein as well as those inherent in the disclosure. While presently preferred embodiments have been described herein, it will be understood that numerous changes may be made which will readily suggest themselves to those skilled in the art and which are accomplished within the spirit of the disclosure and claims.

What is claimed is:

1. A hex tool, the tool comprising:

a hex head having a hex portion for engaging socket head cap screws or wrenches and a body portion extending from the hex portion, the body portion having a spherical-shaped cavity disposed therein; and a handle with a ball end and a primary handle portion, the ball end disposed in the spherical-shaped cavity to provide the hex tool a significant range of motion during use.

2. The hex tool of claim 1 wherein the primary handle portion is separable from the ball end.

3. The hex tool of claim 2 wherein the ball end includes a threaded opening engageable by a threaded shaft extending from the primary handle portion.

4. The hex tool of claim 1 wherein the hex head can be comprised of a single piece of material.

5. The hex tool of claim 1 wherein the hex head can be comprised of at least two parts wherein the at least two parts includes a portion of the spherical-shaped cavity.

6. The hex tool of claim 1 wherein the body portion of the hex head includes an opening therein for the handle to extend therethrough.

7. The hex tool of claim 6 wherein the opening is inset into the body portion of the hex head to increase the range of motion of the handle relative to the hex head.

8. The hex tool of claim 1 wherein the hex portion of the hex head includes outer sidewalls to engage the socket head cap screws or the wrenches.

9. A hex tool, the tool comprising:

a hex head having a hex cavity for engaging a hex head bolt and a body portion extending from the hex cavity, the body portion having a spherical-shaped cavity disposed therein; and a handle with a ball end and a primary handle portion, the ball end disposed in the spherical-shaped cavity to provide the hex tool a significant range of motion during use.

10. The hex tool of claim 9 wherein the primary handle portion is separable from the ball end.

11. The hex tool of claim 10 wherein the ball end includes a threaded opening engageable by a threaded shaft extending from the primary handle portion.

12. The hex tool of claim 9 wherein the hex head can be comprised of a single piece of material.

13. The hex tool of claim 9 wherein the hex head can be comprised of at least two parts wherein the at least two parts includes a portion of the spherical-shaped cavity.

14. The hex tool of claim 9 wherein the body portion of the hex head includes an opening therein for the handle to extend therethrough.

15. The hex tool of claim 14 wherein the opening is inset into the body portion of the hex head to increase the range of motion of the handle relative to the hex head.

16. The hex tool of claim 9 wherein the hex cavity of the hex head includes internal sidewalls to engage a hex head of the hex head bolt.

* * * * *